US006237773B1

(12) United States Patent
Goldman

(10) Patent No.: US 6,237,773 B1
(45) Date of Patent: May 29, 2001

(54) TOY WITH DISPLAY CARD

(75) Inventor: Michael J. Goldman, Marlton, NJ (US)

(73) Assignee: Goldman Toy Group, Inc., Cherry Hill, NJ (US)

( * ) Notice: Subject to any disclaimer, the term of this patent is extended or adjusted under 35 U.S.C. 154(b) by 0 days.

(21) Appl. No.: 09/585,341

(22) Filed: Jun. 2, 2000

(51) Int. Cl.[7] ..... B65D 73/00

(52) U.S. Cl. ..... 206/476; 206/486; 206/493; 53/473; 446/46

(58) Field of Search ..... 206/476, 477–480, 206/461, 486–488, 493, 779, 806, 471; 273/241; 446/46, 488; 473/588, 593; 53/397, 399, 473

(56) References Cited

U.S. PATENT DOCUMENTS

| | | | | |
|---|---|---|---|---|
| 2,663,419 | * | 12/1953 | Bolding et al. | 206/486 |
| 3,298,516 | * | 1/1967 | Leopold | 206/488 |
| 3,576,253 | | 4/1971 | Keats et al. . | |
| 3,847,276 | | 11/1974 | Lehner et al. . | |
| 4,595,097 | | 6/1986 | Herstein . | |
| 4,880,117 | * | 11/1989 | Garganese | 206/487 |
| 4,955,841 | * | 9/1990 | Pastrano | 446/46 |
| 5,020,660 | * | 6/1991 | Akerley et al. | 206/488 |
| 5,152,397 | * | 10/1992 | Mayled | 206/486 |
| 5,411,138 | | 5/1995 | Klawiter . | |
| 5,494,252 | | 2/1996 | Amit et al. . | |
| 5,593,041 | * | 1/1997 | Capozzi | 206/486 |
| 5,711,421 | * | 1/1998 | Guo | 206/486 |
| 5,797,815 | | 8/1998 | Goldman et al. . | |
| 5,919,074 | | 7/1999 | Honda . | |

* cited by examiner

*Primary Examiner*—Luan K. Bui
(74) *Attorney, Agent, or Firm*—Norman E. Lehrer

(57) ABSTRACT

A toy and a display card with an opening and where the toy is held within the opening is disclosed. The toy may be transformed from a three-dimensional, generally polyhedral shape to a flattened shape. The toy includes a shell, a top center, a bottom center, and a plurality of fingers extending between the centers. The toy may hold its flattened shape for a predetermined period of time. When the time period has expired, the toy regains its polyhedral shape. The opening is generally rectangular. The height of the opening is at least as long as the height of the toy in its polyhedral shape and is at least as wide as the centers of the toy. In order to place the toy on the display card, the toy is flattened. The toy is then turned on its side and several of the fingers are inserted through the opening. The toy is then turned so that all of the fingers lie in a horizontal plane. The flattened toy can be slid to the bottom of the opening. The toy may regain its three-dimensional shape so that it fits within the opening and will not fall out. The toy may now be manipulated and played with by the consumer while maintaining it within the display card. That is, the toy may be pressed down into its flattened condition. After the predetermined time period has elapsed, the toy will regain its three-dimensional shape.

15 Claims, 2 Drawing Sheets

TOY WITH DISPLAY CARD

BACKGROUND OF THE INVENTION

The present invention is directed toward a display card for a toy and more particularly, toward a display card which allows a customer to play with the toy while the toy is retained within the card.

It is not uncommon in the retail business and particularly, in the toy industry, to display products in such a manner as to allow the consumer to operate the product prior to purchase and while it remains in its package. The purpose of this type of packaging is to enable the consumer to try the product without compromising the integrity of the packaging protection of the product. Furthermore, the packaging must also be secure so as to ensure that the product cannot be removed from the packaging until after the product has been purchased.

Various types of packaging which serve the purposes described above have been disclosed in prior patents. For example, U.S. Pat. No. 5,494,252 to Amit et al. discloses a device for effecting relative motion of movable components of a product within a closed sales display package. This packaging, however, does not allow the consumer to access the product in order to fully appreciate the product and how it functions.

Also, U.S. Pat. No. 5,411,138 to Klawiter discloses packaging for a toy. The packaging includes a box with a slot which allows a consumer to operate the toy without having to remove the toy from the packaging. This packaging, however, is rather constricting and does not allow the consumer to play with the product.

Further, U.S. Pat. No. 4,595,097 to Herstein discloses packaging for a toy which includes a box with an open front through which the toy is displayed and through which the toy may be examined by a consumer. The packaging, however, prevents a consumer from playing with the toy in the proper manner in order to try it out before the toy has been purchased. That is, the toy cannot properly be used without destroying the packaging.

SUMMARY OF THE INVENTION

The present invention is designed to overcome the deficiencies of the prior art discussed above. It is an object of the present invention to provide a display card for a toy which allows a customer to play with the toy while it is still in its package.

It is another object of the present invention to provide a display card for a toy where the display cards may be easily displayed and stored on a display rack in a store in a space efficient manner.

In accordance with the illustrative embodiments demonstrating features and advantages of the present invention, there is provided a display card with an opening and a toy which is held within the opening. The toy may be transformed from a three-dimensional, generally polyhedral shape to a flattened shape. The toy has a shell, a top center, and a bottom center. Extending between the centers are a number of contoured regions. In its flattened condition the contoured regions form fingers which are connected to the centers via living hinges. The toy may hold its flattened shape for a predetermined period of time. When the time period has expired, the toy regains its polyhedral shape. The opening in the card is generally rectangular. The height of the opening is at least as long as the height of the toy in its polyhedral shape and is as wide as the centers of the toy. In order to place the toy on the display card, the toy is flattened. The toy is then turned on its side and several of the fingers are inserted through the opening. The toy is then turned so that all of the fingers lie in a horizontal plane. The flattened toy can be slid to the bottom of the opening. The toy may regain its three-dimensional shape so that it fits within the opening and will not fall out. The toy may now be manipulated and played with by the consumer while maintaining it within the display card. That is, the toy may be pressed down into its flattened condition. After the predetermined time period has elapsed, the toy will regain its three-dimensional shape.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
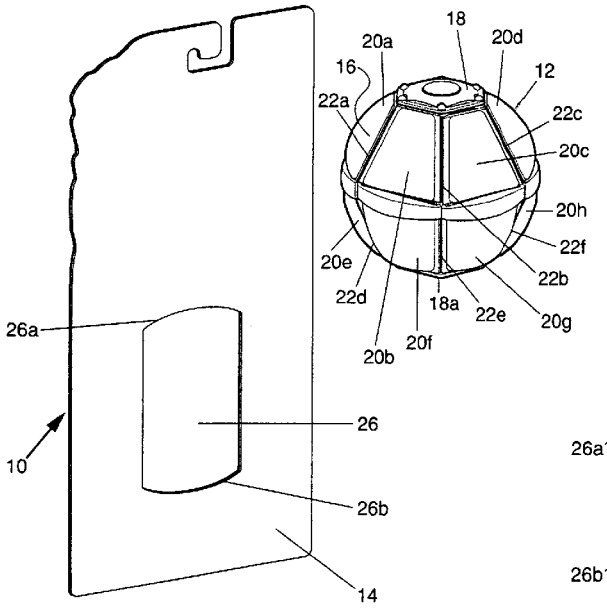
FIG. 1 is a front perspective view of the toy and display card of the present invention.

Referring now to the drawings in detail wherein like reference numerals have been used throughout the various figures to designate like elements, there is shown in FIG. 1 a toy and display card constructed in accordance with the principles of the present invention and designated generally as 10.

Figure 2:
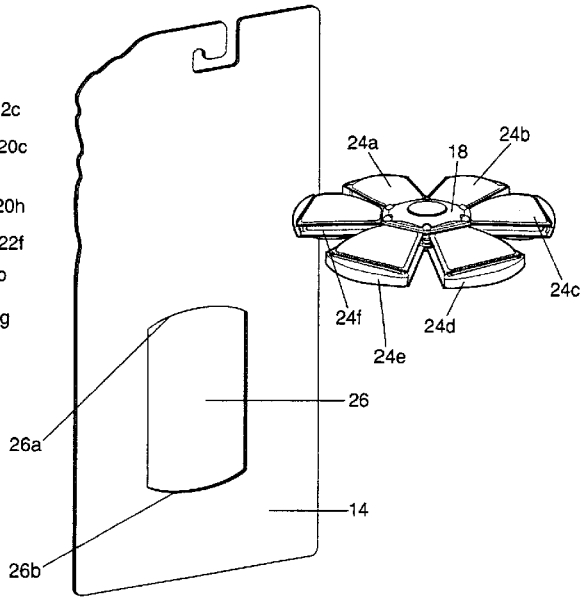
FIG. 2 illustrates the toy in a flattened condition prior to be being inserted within an opening of the display card of the present invention.

The present invention essentially includes a toy 12 which may change shape and a display card 14 for the toy 12. The toy 12 may be transformed from a three-dimensional, generally polyhedral shape to a flattened shape. In its polyhedral shape, the toy 12 resembles a ball and includes a shell structure 16 having a top hexagonal center 18 and a bottom hexagonal center 18*a*. A plurality of contoured regions 20*a*–20*h* extend between the top center 18 and the bottom center 18*a*. The top center 18 and the bottom center 18*a* are curved slightly. (See FIG. 1.) A number of surface grooves 22*a*–22*f* are formed by the borders lying between adjacent contoured regions. The contoured regions 20*a*–20*h* form a plurality of fingers 24*a*–24*f* when the toy 12 is in its flattened condition. (See FIG. 2.) Each finger 24*a*–24*f* has several living hinges (not shown) formed along its length. The living hinges join the fingers 24*a*–24*f* to the top center 18 and bottom center 18*a*. These living hinges allow each finger 24*a*–24*f* to change shape from generally flat to generally curved, thereby forming part of the overall polyhedral shape. The toy 12 may hold its flattened shape for a predetermined period of time. When the time period has expired, the toy 12 regains its polyhedral shape. The toy is described in greater detail in U.S. Pat. No. 5,797,815 to Goldman et al. which is herein incorporated by reference.

The display card 14 is generally rectangular with an elongated, substantially rectangularly shaped opening 26 located adjacent an end of the card 14. The top 26*a* of the opening 26 is curved slightly. Similarly, the bottom 26*b* of the opening is also slightly curved. (See FIG. 1.) Preferably, the height of the opening 26 is substantially equal to the height of the toy 12 when in its expanded condition. It should be realized, however, that the height of the opening 26 may be greater than the height of the toy 12. The width of the opening 26 is preferably slightly wider than the diameter of the centers 18 and 18*a* of the toy 12. Although the width of the opening 26 can be slightly wider than the diameter of the centers 18 and 18*a*, it cannot exceed the width of the toy 12 when in its expanded shape. The card may be made from paper board, card board, plastic, or other sheet-like material.

Figure 3:
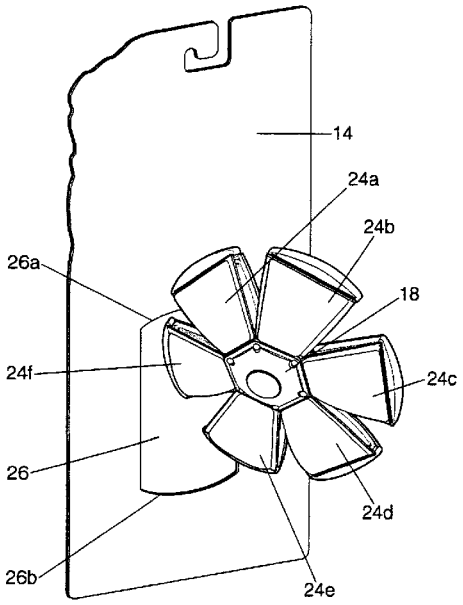
FIG. 3 illustrates the toy being turned on its side, in a flattened condition and being inserted into the opening of the display card of the present invention.
Figure 4:
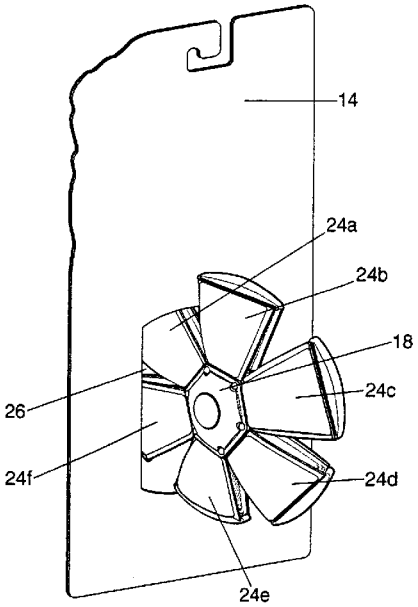
FIG. 4 is a front perspective view of the toy in a flattened condition inserted within the opening of the display card of the present invention.
Figure 5:
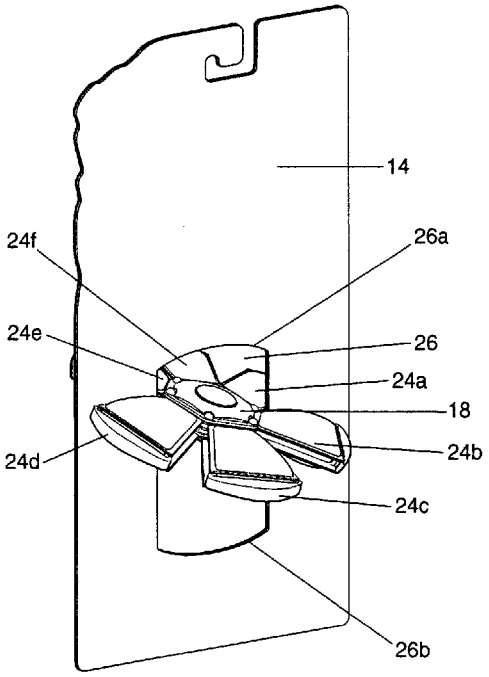
FIG. 5 illustrates the toy in a flattened condition inserted within the opening of the display card of the present invention.
Figure 6:
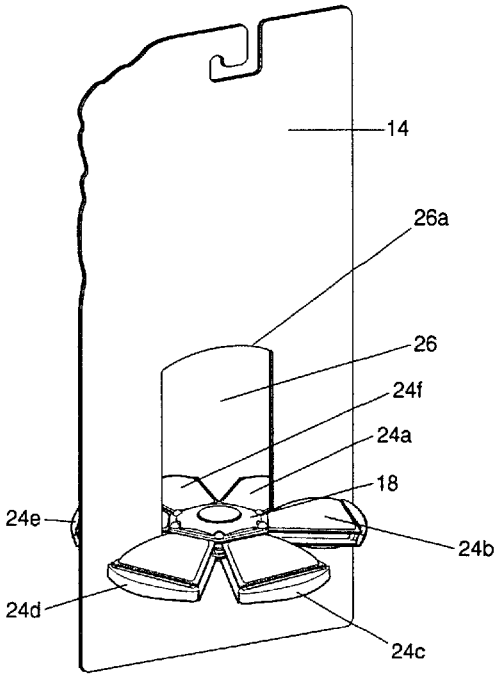
FIG. 6 is a front perspective view of the toy in a flattened condition located at the bottom of the opening of the display card of the present invention.

In order to mount the toy 12 within the display card 14, the toy 12 is flattened. (See FIG. 2.) The toy 12 is then turned on its side or is aligned so that the toy 12 lies in a plane substantially parallel to the height of the opening 26 and perpendicular to the card 14. Fingers 24*a*, 24*e*, and 24*f* are inserted through the opening 26. (See FIGS. 3 and 4.) The toy 12 is then turned so that all of the fingers 24*a*–24*f* lie in a substantially horizontal plane. (See FIG. 5.) The flattened toy 12 can be slid to the bottom 26*b* of the opening 26. (See FIG. 6.) The toy 12 may regain its three-dimensional shape so that it fits within the opening 26 and will not fall out. That is, the curve of the top center 18 is complimentary to the curve of the top 26*a* of the opening 26 and the curve of the bottom center 18*a* is complimentary to the curve of the bottom 26*b* of the opening 26. (See FIG. 7.) Also, the right and left sides of the card 14 adjacent the opening 26 extend through the interior of the toy 12 regardless of the toy 12 being in its expanded position or flattened position. (See FIGS. 6 and 7.)

Figure 7:
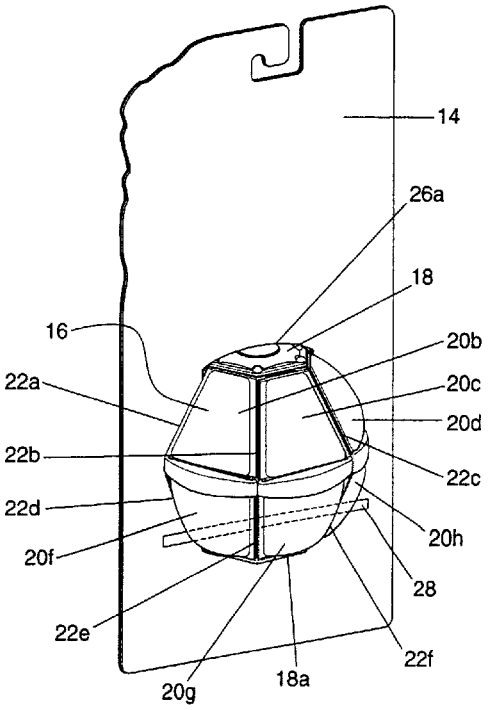
FIG. 7 illustrates the toy in a three-dimensional shape within the opening of the display card of the present invention.

To further ensure that the toy 12 will not be inadvertently removed from the card 14 while being tried, it may be more securely held in place by a thin plastic flat strip or the like 28 as shown in FIG. 7. After the toy 12 is mounted on the card 14 and expands to its three-dimensional shape, the strip 28 is inserted through the interior of the toy between the lower portion of adjacent fingers on the front and back of the card 14. The ends of the strip 28 are then heat sealed or otherwise secured to the face of the card. For aesthetic purposes, the strip is preferably secured to the back face of the card. As should be readily apparent, because of the size, shape and location of the strip 28, it does not interfere with the proper operation of the toy 12 mounted on the card.

The toy 12 may now be manipulated and tried or played with by the consumer while maintaining it within the display card 14. That is, the toy 12 may be pressed down into its flattened condition. After the predetermined time period has elapsed, the toy 12 will regain its three-dimensional shape. During this manipulating process, the opening in the card acts as a guide to ensure proper alignment and, therefore, proper functioning of the toy.

Although the opening 26 is shown as being located adjacent the bottom half of the card, it should be understood that it may be centered on the card or located adjacent the top thereof. Preferably, some cards should have the opening located adjacent the top of the card while others should have the opening located adjacent the bottom of the card. This allows the toys to be stacked on a display rack in an efficient manner. For example, the toys can now be stacked in alternating high and low positions on the display rack by positioning the toy in either an opening located near the top of the card or in an opening located near the bottom of the card. In this manner more of the toys may be displayed on the rack.

The present invention may be embodied in other specific forms without departing from the spirit or essential attributes thereof and accordingly, reference should be made to the appended claims rather than to the foregoing specification as indicating the scope of the invention.

I claim:

1. A combination of a toy and a display card comprising:

a toy comprising a shell, a top center, a bottom center, and a plurality of fingers extending between said top center and said bottom center, said toy being able to selectively change from an expanded three-dimensional, polyhedral shape into a flattened shape;

a card having a substantially rectangular opening therein, said toy interfitting within said opening so as to be carried by said card while being capable of being moveable between its expanded and flattened shapes; and means extending across said opening for securing said toy to said card wherein said securing means includes a flat strip extending across said opening and through the interior of said toy and having its ends secured to said card.

2. The combination of a toy and a display card of claim 1 wherein said opening of said card has a height substantially equal to the height of said toy when in its expanded shape.

3. The combination of a toy and a display card of claim 1 wherein said opening of said card has a width substantially equal to the width of one of said centers of said toy.

4. The combination of a toy and a display card of claim 1 wherein said opening has a curved top and a curved bottom.

5. The combination of a toy and a display card of claim 4 wherein said top center and said bottom center of said toy are curved.

6. The combination of a toy and a display card of claim 5 wherein said top of said opening is complimentary to said top center of said toy and said bottom of said opening is complimentary to said bottom center of said toy.

7. A method of mounting a toy within a display card comprising the steps of:

providing a toy comprising a shell, top and bottom centers, and a plurality of fingers, said toy being able to selectively change from an expanded three-dimensional, polyhedral shape into a flattened shape and the card having a substantially rectangular opening therein, said opening having a height and a width, said toy fitting within said opening;

flattening said toy;

aligning said toy so that said toy is in a plane substantially parallel to said height of said opening and perpendicular to said card;

inserting said toy through said opening of said card;

turning said toy so that all of said fingers lie in a substantially horizontal plane; and allowing said toy to expand to its three-dimensional shape so that said toy fits within said opening and can be manipulated without falling out.

8. A combination of a toy and a display card comprising:

a toy comprising a shell, a top center, a bottom center, and a plurality of fingers extending between said top center and said bottom center, said toy being able to selectively change from an expanded three-dimensional, polyhedral shape into a flattened shape and a card having a substantially rectangular opening therein, said toy interfitting within said opening so as to be carried by said card while being capable of being moveable between its expanded and flattened shapes and the sides of said card adjacent said opening extending through th e interior of said toy.

9. The combination of a toy and a display card of claim 8 wherein said opening of said card has a height substantially equal to the height of said toy when in its expanded shape.

10. The combination of a toy and a display card of claim 8 wherein said opening of said card has a width substantially equal to the width of one of said centers of said toy.

11. The combination of a toy and a display card of claim 8 wherein said opening has a curved top and a curved bottom.

12. The combination of a toy and a display card of claim 11 wherein said top center and said bottom center of said toy are curved.

13. The combination of a toy and a display card of claim 12 wherein said top of said opening is complimentary to said top center of said toy and said bottom of said opening is complimentary to said bottom center of said toy.

14. The combination of a toy and a display card of claim 8 further including means extending across said opening for securing said toy to said card.

15. The combination of a toy and a display card of claim 14 wherein said securing means includes a flat strip extending across said opening and through the interior of said toy and having its ends secured to said card.

* * * * *